US006164868A

United States Patent [19]

Goughnour

[11] Patent Number: 6,164,868

[45] **Date of Patent: *Dec. 26, 2000**

[54] PREFABRICATED VERTICAL EARTH DRAIN WITH RELIEF PROTRUSIONS

[76] Inventor: R. Robert Goughnour, 705 Duff Rd. NE., Leesburg, Va. 20176

[ * ] Notice: This patent is subject to a terminal disclaimer.

[21] Appl. No.: 09/294,625

[22] Filed: Apr. 19, 1999

[51] Int. Cl.[7] ..... E02B 11/00; E02D 19/00

[52] U.S. Cl. ..... 405/43; 52/169.5

[58] Field of Search ..... 405/45, 43; 52/169.5, 52/169.14

[56] References Cited

U.S. PATENT DOCUMENTS

| | | | |
|---|---|---|---|
| 4,749,306 | 6/1988 | Demeny et al. | 405/45 |
| 4,943,185 | 7/1990 | McGuckin et al. | 405/45 |
| 5,489,462 | 2/1996 | Sieber | 428/174 |
| 5,820,296 | 10/1998 | Goughnour | 405/43 |

FOREIGN PATENT DOCUMENTS

| | | | |
|---|---|---|---|
| 48-25765 | 7/1973 | Japan | 405/45 |

*Primary Examiner*—David Bagnell
*Assistant Examiner*—Sunil Singh
*Attorney, Agent, or Firm*—Carothers & Carothers

[57] ABSTRACT

A prefabricated vertical earth drain which is provided with an elongated corrugated flexible plastic core sheet with vertical and horizontal dimensions of extension and horizontal corrugations which provide continuous longitudinally extending drain channels that extend in the vertical direction. These drain channels are defined with curved corrugation bends and a series of longitudinally spaced relief protrusions are provided in the channels. In use, the entire structure is surrounded with a filter fabric. The relief protrusions assist in preventing the protrusion of filter fabric into the drain channels.

12 Claims, 7 Drawing Sheets

PREFABRICATED VERTICAL EARTH DRAIN WITH RELIEF PROTRUSIONS

BACKGROUND OF THE INVENTION

This invention relates generally to soil stabilization, and more particularly to the prefabricated vertical earth drains used to accelerate consolidation of soft clays.

The present invention pertains to improvements in prefabricated vertical earth drains of the type disclosed in the present inventor's U.S. Pat. No. 5,820,296. Reference should be made to the discussion presented in the background of the disclosure of this patent for an understanding of the uses and applications of such prefabricated vertical earth drains.

Prior art prefabricated vertical earth drains are usually either configured of elongated corrugated strips of flexible plastic core sheets having horizontal corrugations which provide continuous longitudinally extending drains in the vertical direction, which longitudinal corrugations are defined with sharp corner bends, as disclosed in the inventor's previously mentioned U.S. Pat. No. 5,820,296; or they are constructed with flexible plastic core sheets which have a dimpled or studded surface configuration as illustrated in U.S. Pat. Nos. 4,749,306; 4,943,185 and 5,489,462, or as illustrated in FIGS. 1 and 2 of the drawings attached to this specification. In FIGS. 1 and 2 the core sheet 10 is diagrammatically and schematically shown and provided with multiple uniformly spaced studs 11 of solid cross section. These prefabricated vertical earth drains are composite in construction in that the plastic core or cores are provided with an outer wrap or surrounding of filter fabric 12 generally referred to as geofabric or geotextile in the industry which prevents clogging of the water drains provided in the core material with particles of soil or earth.

While the prefabricated composite vertical earth drains as described in the inventor's U.S. Pat. No. 5,820,296 do provide considerable improvement over the prior art in that added strength is provided to the core material by the added reliefs to assist in preventing collapsing of the cores from soil pressure whereby buckling or folding of the core is experienced, nevertheless, room for improvement remains. In addition, another problem also exists with the composite prefabricated earth drains of the type disclosed in the inventors previously referenced patent and in the other prior art types previously referenced in that under compressive forces applied when the drain is imbedded in the earth, the geofabric or filter fabric is compressively deformed excessively depressed into recesses of these core drain channels and the drain channels themselves are deformed and made more shallow. Accordingly, the added sag or protrusion of the geofabric into the drain channels of the core and deformation of the drain channels constricts the flow of water thereby reducing the efficiency and flow capacity of the drain.

This latter mentioned problem is illustrated in FIGS. 1 and 2 which illustrate the geofabric sag pattern over the studded drain core 10 (FIG. 1 in perspective and FIG. 2 in cross section) and deformed under pressure as would occur when the drain is imbedded in the earth.

In this regard, note that the geofabric 12 fully surrounds the flexible drain core sheet 10 which is provided with multiple dimples or studs 11. The geofabric 12 sags between the studs to an undesirably low level as indicated at 13 and further fully engages and depresses the geofabric 12 against the outer surfaces of the studs 11 as indicated at 14 thereby considerably constricting the flow of water between, over and around the studs.

Similarly, with reference to FIG. 3, a cross section of the composite drain members of the type illustrated in the inventor's U.S. Pat. No. 5,820,296 is illustrated with the geofabric and core drain channels being deformed under pressure as indicated by arrows 15 applied by the surrounding earth. Here the corrugated drain member core 16 is provided with vertical drain channels 17 and relief protrusions 18.

In this illustration, the channels 17 do remain in a more open condition than the channels provided between solid studs 14 of the core structure shown in FIG. 2, however, the core structure deforms and the geofabric 12 compresses against the outer sides of the channels against the relief protrusions 18 thereby limiting the water flow capabilities of and between the respective channels 17 excessively as illustrated. In addition, this corrugated core material of sharp angled corrugation bends, while strengthened by the relief protrusions 18 to lessen the possibility of deforming and folding in the core member 16 in the horizontal direction indicated by arrow 22, nevertheless is still prone to possible horizontal folding, although not to the excessive extent encountered with the other prior art corrugated or dimpled core members or sheets.

SUMMARY OF THE INVENTION

The prefabricated vertical earth drain of the present invention is of the composite type having a drain core provided with an external wrapping of geofabric. The core itself is a novel configuration and is provided with an elongated corrugated flexible plastic core sheet with vertical and horizontal dimensions of extension. Horizontal corrugations are provided which in turn provide continuous longitudinally extending drain channels that extend in the vertical direction. The improvement resides in the fact that these corrugations are defined with arched or curved corrugation bends as opposed to the sharp cornered or angled corrugations of the prior art and selected of these corrugation channels are provided with a series of longitudinally spaced relief protrusions.

These arched or curved corrugations bends provide considerably more strength to the plastic sheet material of the core in assisting in the prevention of horizontal folds, bends or creases under shifting installation loads.

In addition, the spaced relief protrusions provided in these curved channels not only further assist in rigidity of the structure and in the prevention of horizontal bends in the core, but assists in holding the geofabric away from the core material in order to prevent minimum protrusion or sagging of the geofabric into the core channels and to provide maximum possible flow between channels.

Additional strength is imparted to the core sheet by reason of the fact that the relief protrusions are continuously curved in their direction of horizontal extension.

In addition, the sharp cornered corrugated channels of the core structures of the prior art do not permit the relief protrusions to extend beyond the angled corner bends of the corrugation channels. To the contrary, the curved corrugations of the core structure of the present invention permit the spaced relief protrusions to extend in their horizontal direction from approximately 120° to 180° through or beyond the channel curved corrugation bends thereby increasing the ability of the relief protrusions to further hold the filter fabric away from the core surfaces and channels in order to provide maximum flow within the core channels and between the core channels.

The series of relief protrusions may be uniformly spaced and they may have a saw-tooth configuration or a sinusoidal configuration in longitudinal cross section along the core channels.

Also, the relief protrusions may be provided in adjacent corrugation channels whereby they protrude in the same direction in adjacent channels, or whereby they protrude in opposite directions in adjacent channels.

BRIEF DESCRIPTION OF THE DRAWINGS

Other objects and advantages appear hereinafter in the following description and claims. The accompanying drawings show, for the purpose of exemplification, without limiting the invention or claims thereto, certain practical embodiments illustrating the principals of this invention wherein:

DETAILED DESCRIPTION OF THE PREFERRED EMBODIMENTS

Figure 4:
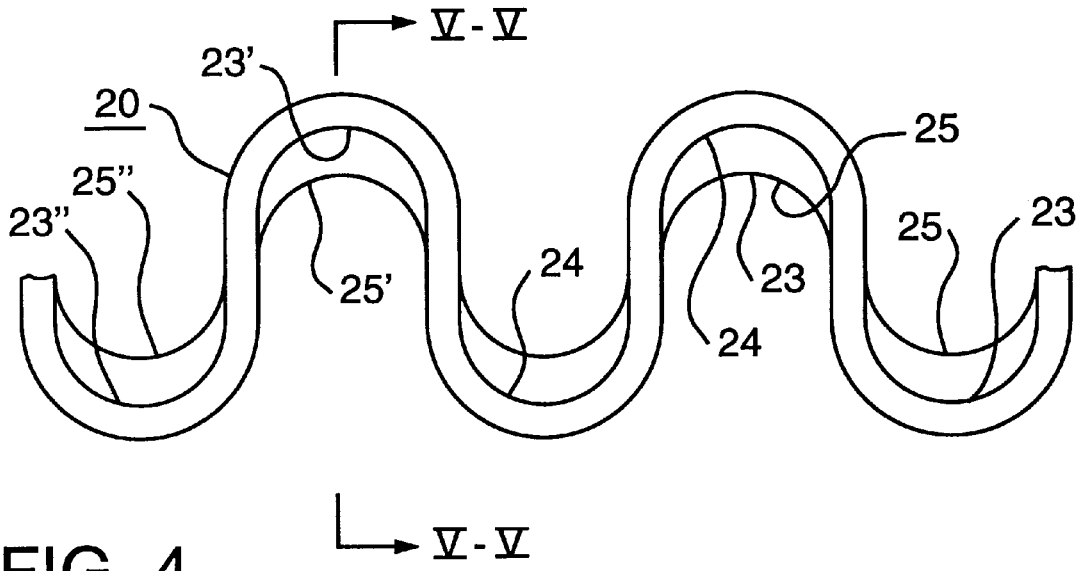
FIG. 4 is an end view of a segment or portion of one embodiment of the core member of the prefabricated composite vertical earth drain of the present invention.
Figure 5:
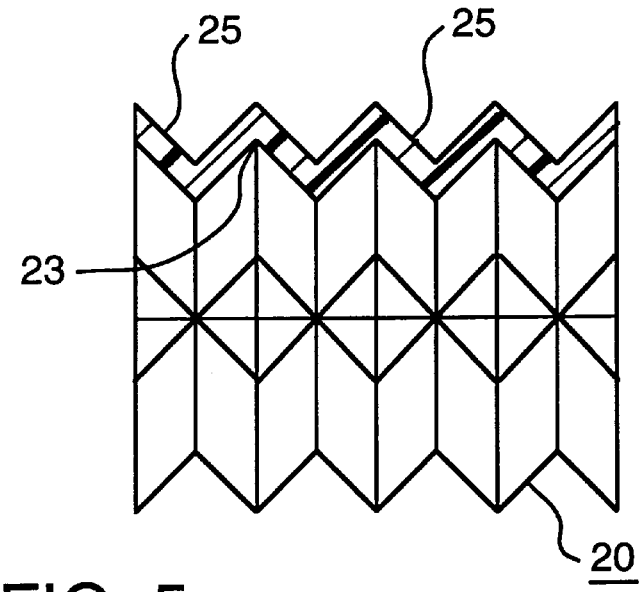
FIG. 5 is an enlarged view in cross section illustrating the cross section of the spaced relief protrusions provided on the core structure shown in FIG. 4 as seen along section line V—V.
Figure 6:
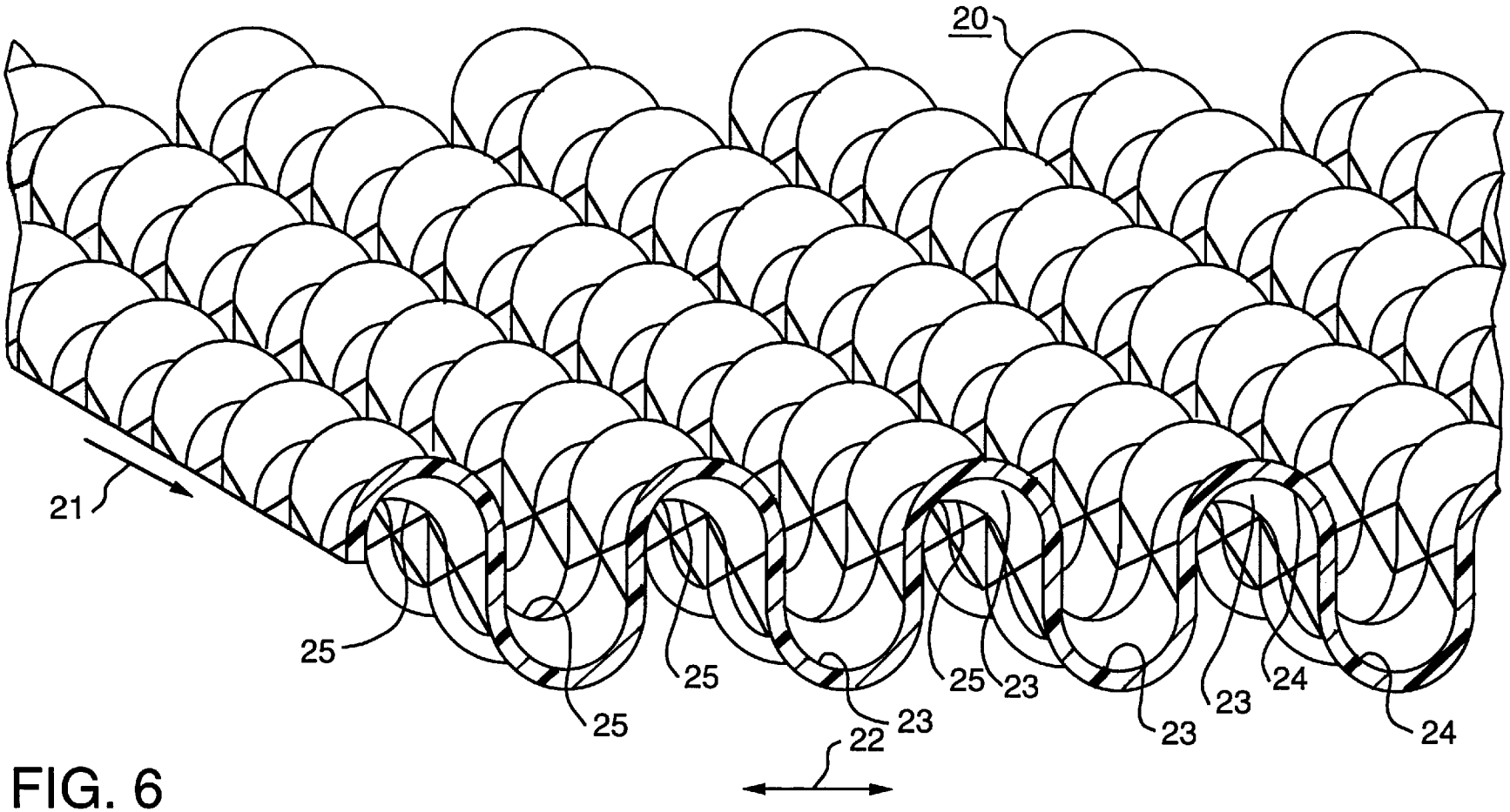
FIG. 6 is a perspective view of the core structure shown in FIG. 4.

Referring to FIGS. 4, 5 and 6, a first embodiment of the elongated corrugated flexible plastic core strip or sheet 20 of the present invention is illustrated. For example, this elongated strip or sheet 20 might typically be four inches wide with drain channels which are 0.1 to 0.2 inches deep.

In this embodiment, the elongated core sheet 20 is provided with vertical dimensions of extension 21 as indicated in FIG. 6, and horizontal dimensions of extension as indicated by arrow 22 in FIG. 6. Sheet 20 is provided with horizontal corrugations providing continuous longitudinally extending g drain channels 23 which extend in the vertical direction 21. These drain channels 23 are defined with curved corrugation bends 24 which provide arched or curved channels 23 as opposed to sharp cornered channels of the prior art. Selected of these corrugation channels 23 are provided with a series of longitudinal spaced relief protrusions 25. In the embodiment illustrated here, all of the corrugation channels 23 are provided with a series of longitudinally spaced relief protrusions 25.

These relief protrusions are uniformly spaced and have a saw tooth configuration in longitudinal cross section along the channels 23 as is illustrated in FIG. 5. They are also continuously curved in their direction of horizontal extension for providing additional strength to the core sheet and they extend through an arch of approximately 180°. They preferably extend through an arch of approximately 120° to 180° in order to better minimize protrusion of filter fabric into the channels 23.

In addition, note that the relief protrusions 25 have a longitudinal spacing which is shorter than that for the longitudinal corrugations providing vertical channels 23. This assists in preventing excessive protrusion of geofabric into the spaces between relief protrusions 25.

Also, in the embodiment of FIGS. 4 through 6, the relief protrusions 25 are provided in adjacent corrugation channels 23 and all relief protrusions in respective adjacent channels 23 protrude in the opposite direction. This is easily visualized by reference to FIG. 4. Note in FIG. 4 that the relief protrusions in respective channels 23' and 23" protrude in the opposite direction or downwardly in channel 23' and upwardly in channel 23".

Figure 7:
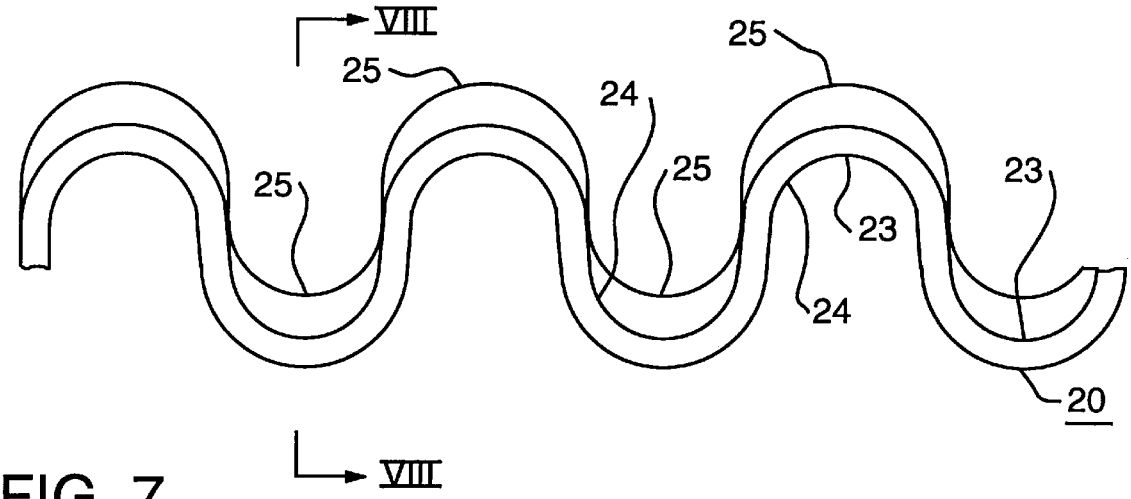
FIG. 7 is an end view of a portion of a second embodiment of the core member of the prefabricated composite vertical earth drain of the present invention.
Figure 8:
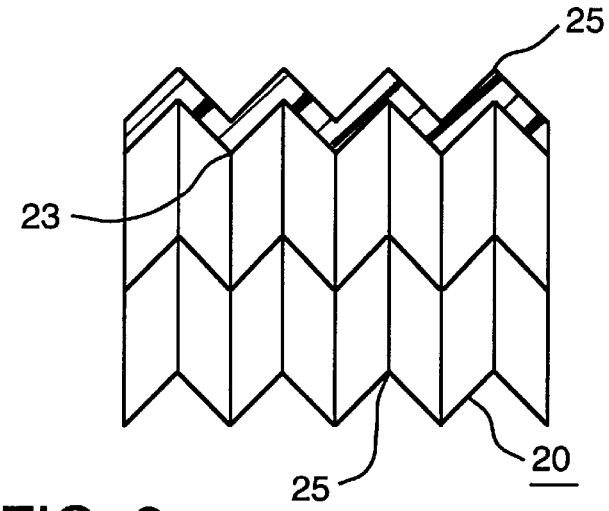
FIG. 8 is an enlarged view in cross section illustrating the cross section of the spaced relief protrusions provided on the core structure shown in FIG.7 as seen along section line VIII—VIII.
Figure 9:
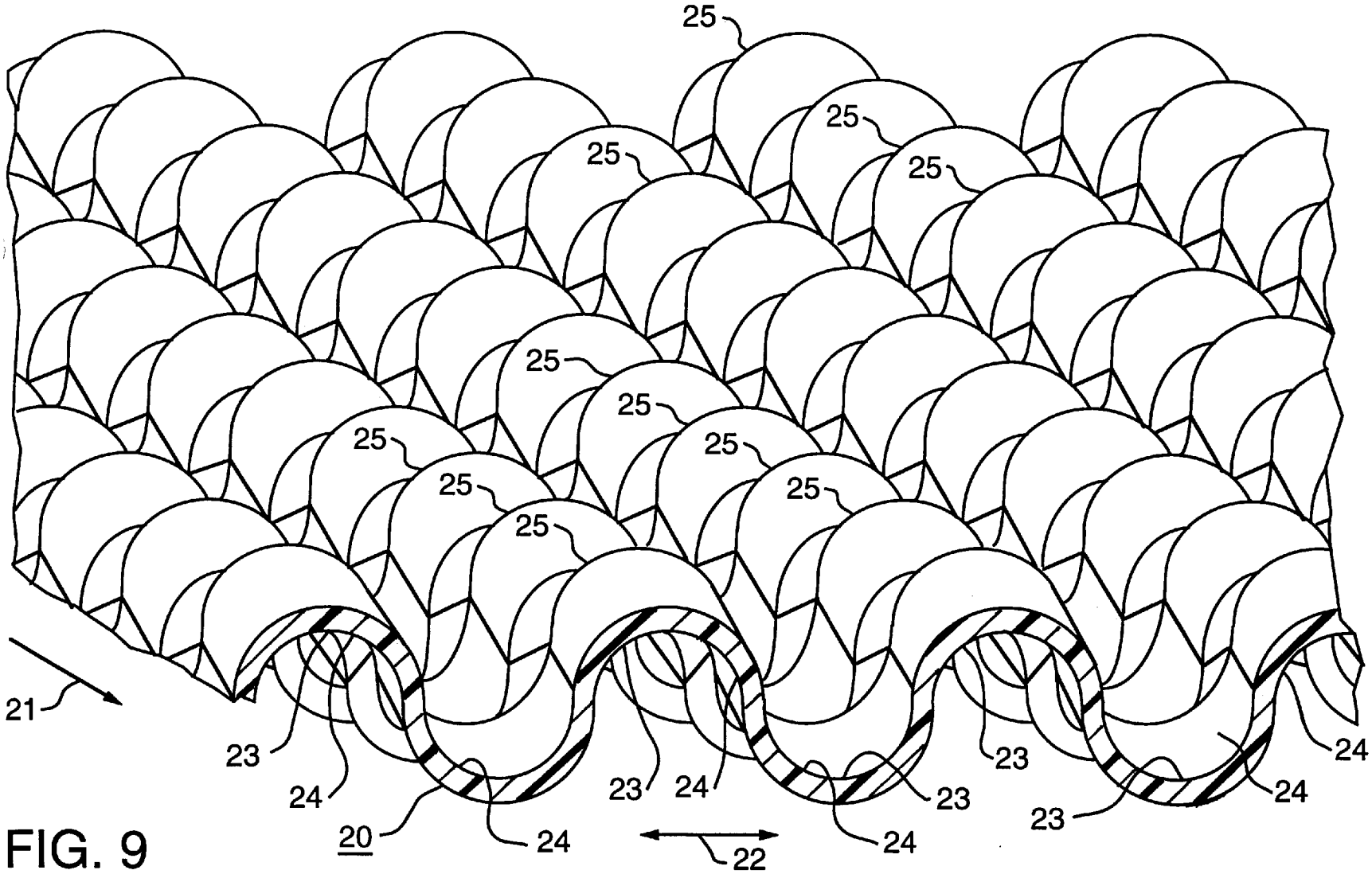
FIG. 9 is a perspective view of the core structure shown in FIG. 7.
Figure 10:
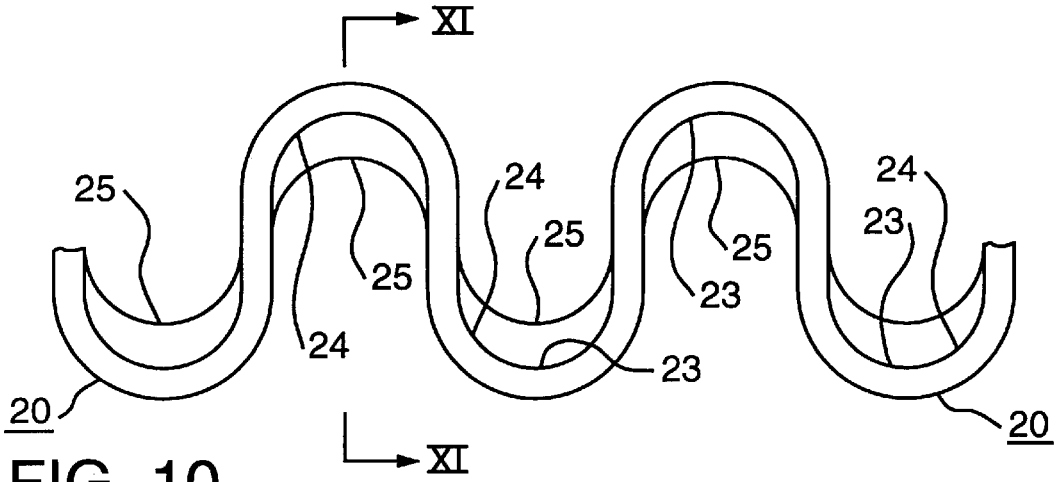
FIG. 10 is an end view of a portion of a third embodiment of the core member of the prefabricated composite vertical earth drain of the present invention.

Referring next to the plastic core sheet 20 of the present invention as illustrated in the embodiment of FIGS. 7, 8 and 9, the core sheet here illustrated is in all respects quite similar to the core sheet of the present invention as illustrated in FIGS. 4 through 6, with the exception that in this embodiment relief protrusions 25, while being provided once again in all channels 23, are provided in adjacent channels 23 such that they protrude in the same direction, instead of the opposite directions as in the previous embodiment.

This is best illustrated in FIG. 7 where it may be observed that the relief protrusions 25 protrude or project in the same direction in adjacent channels.

For example, note in FIG. 4 that relief protrusions 25' in channel 23' protrusions 25" in adjacent channel 23" protrude into their respective channels 23' and 23". They therefore protrude in opposite directions in adjacent channels.

Figure 11:
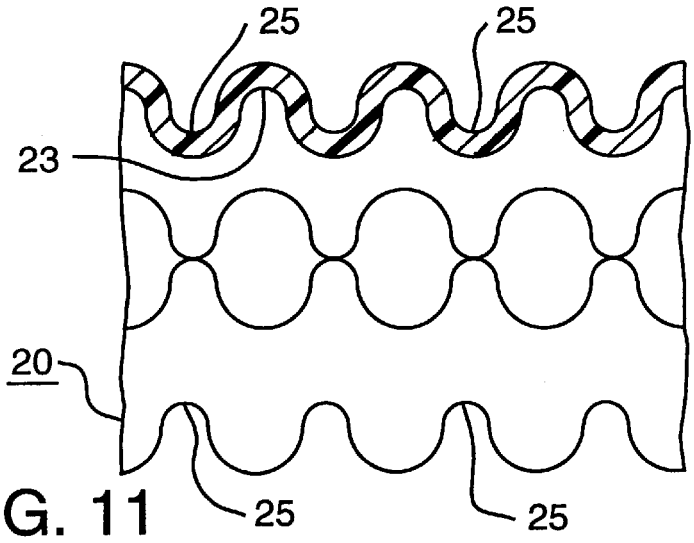
FIG. 11 is an enlarged view in cross section illustrating the cross section of the spaced relief protrusions provided on the core structure shown in FIG. 10 as seen along section line XI—XI.

Yet another embodiment of the flexible plastic core sheet 20 of the present invention is illustrated which in most respects is extremely similar to the embodiment illustrated in FIGS. 4 through 6, with the exception that in this embodiment, the relief protrusions 25 are provided with a sinusoidal configuration in longitudinal cross section along channels 23 as illustrated in FIG. 11 instead of a saw tooth configuration as illustrated in the previous embodiments.

Figure 12:
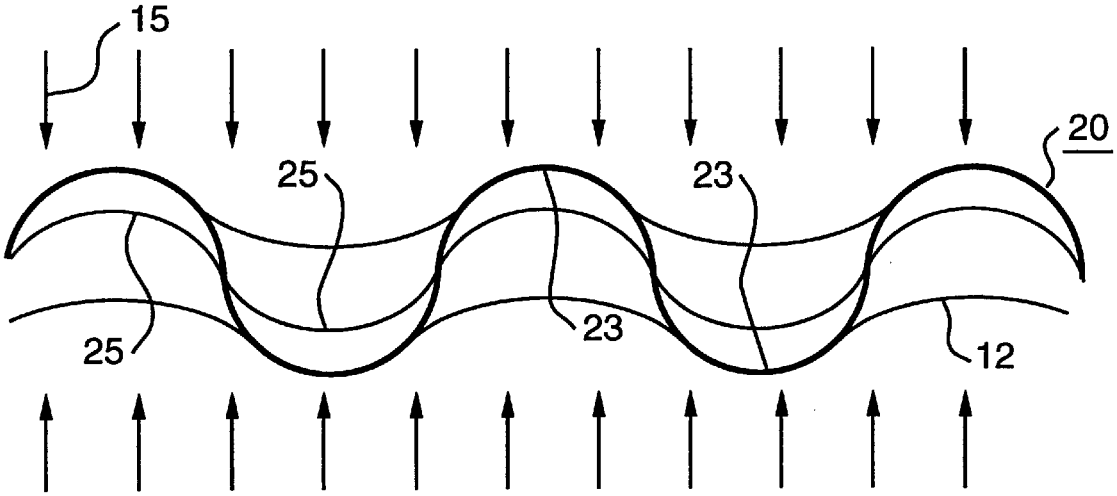
FIG. 12 is a schematic end view of the composite prefabricated vertical earth drain core of the present invention as disclosed in FIG. 7 with geofabric applied thereto and as illustrated under surrounding pressure when embedded in the earth.

The advantages of the flexible plastic core sheet of the present invention is diagrammatically or schematically illustrated in FIG. 12.

Figure 1:
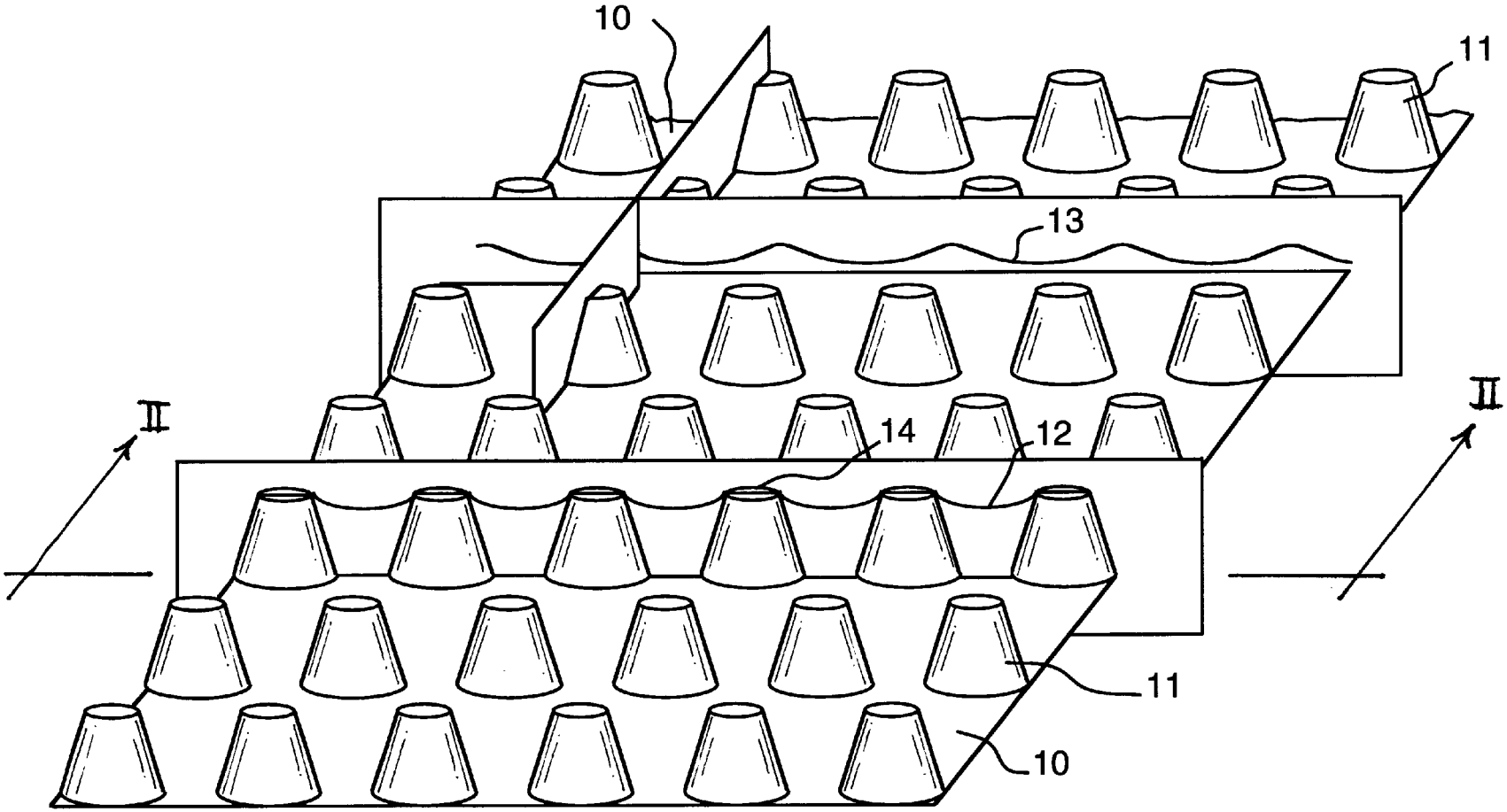
FIG. 1 Prior Art
FIG. 1 is a schematic and diagrammatic perspective view of a drain core of the studded type of the prior art with geofabric applied under pressure of surrounding soil.
Figure 2:
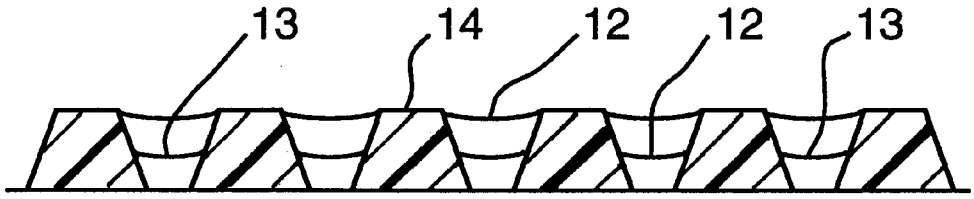
FIG. 2 Prior Art
FIG. 2 is a view in vertical cross section of the prior art drain core illustrated in FIG. 1 as seen along section line II—II and with geofabric applied over the exterior.
Figure 3:
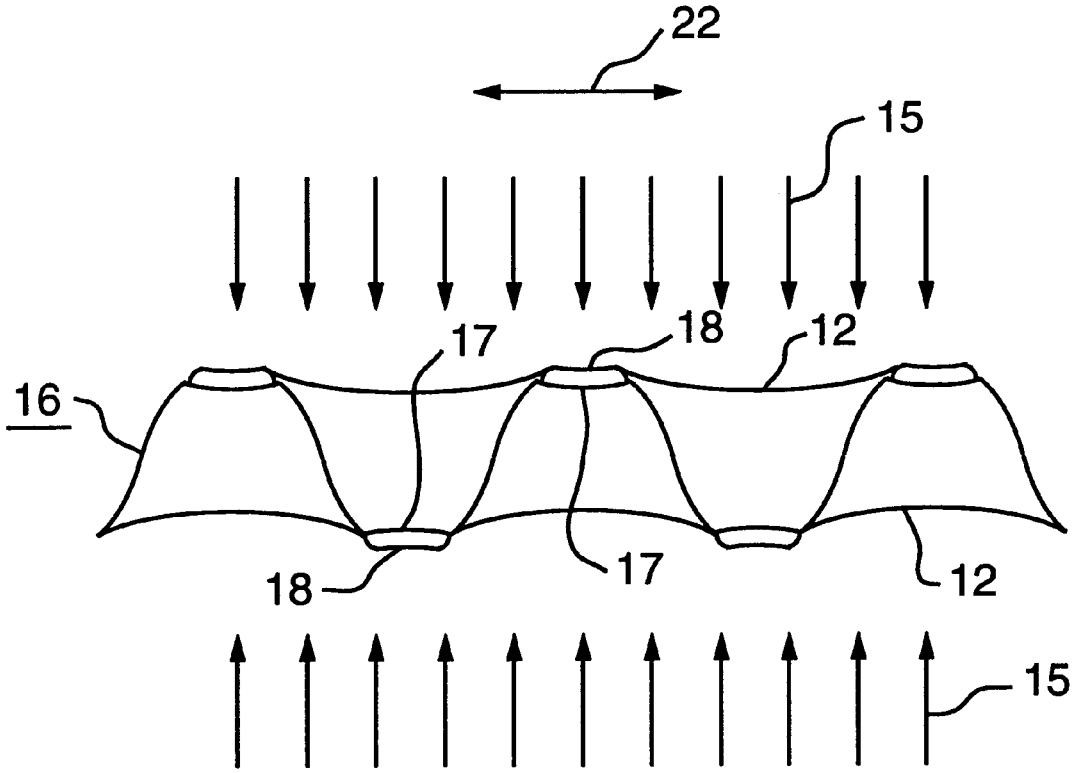
FIG. 3 Prior Art
FIG. 3 is a schematic view in vertical cross section of the prior art composite earth drain structure of the type disclosed in U.S. Pat. No. 5,820,296 as shown in deformed condition under pressure applied from the surrounding earth when the drain member is embedded.

Here the core sheet 20 of the present invention is illustrated with applied geofabric 12 and embedded as a composite structure into the earth under the same earth pressures as indicated by arrows 15 as applied to the prior art structure of FIG. 3.

First of all, it should be noted that the corrugated sheet 20 of the present invention with arched or curved channels 23 does not deform as illustrated with the prior art structure of FIG. 3 and accordingly the respective channels 23 are maintained in a more opened condition, and the geofabric 12 cannot therefore penetrate as deeply into the channels 23.

Also, the core sheet 20 is of the embodiment illustrated in either FIGS. 4 through 6, or FIGS. 10 through 11 wherein the relief protrusions 25 in adjacent channels 23 extend in opposite directions or into their respective channels 23.

From viewing FIG. 12 it can be realized that first of all the geofabric 12 does not contact as much of the outside surfaces of respective channels 23 due to the curved configuration of the channels as does the geofabric 12 in contacting the outside surfaces of the prior art core sheets, such as illustrated in FIG. 3.

Secondly, because of the continuously curved relief protrusions 25 which extend through arches of approximately 120° to 180°, in combination with the arched or curved channels 23 of the core structure 20 of the present invention, the geofabric 12 is held away from continuous contact with the interiors of channels 23 and with the outside surfaces of the core sheet 20 to a greater degree than possible in the prior art structure of FIG. 3. This not only permits greater flow within channels 23, but also even permits cross flow between every other or alternate channels 23 through the passage ways defined between adjacent relief protrusions 25 uniformly spaced along the channel bottoms 23.

Note with the prior art structure of FIG. 3, that the geofabric tends to cut off any such cross flow between relief protrusions 18. This is because the relief protrusions 18 cannot or are not permitted to extend through the corner bends of the core sheet material 16 which form the respective channels 17 and are not continuously curved in their direction of horizontal extension.

To the contrary, as illustrated in FIG. 12, the arched or curved configurations of the channels 23 of the core sheet material 20 of the present invention permits the continuously curved relief protrusions 25 to extend well through and beyond the outside curved bends which form the respective channels 23 in a continuous smooth fashion. This provides a much stronger structure which is more resistant to compressive deformation, horizontal folding and clogging of drain channels due to sagging intrusion of the geofabric.

I claim:

1. A prefabricated vertical earth drain comprising: an elongated corrugated flexible plastic core sheet with vertical and horizontal dimensions of extension and having horizontal corrugations providing continuous longitudinally extending drain channels extending in the vertical direction and defined with curved corrugation bends, selected ones of said corrugation channels having a series of longitudinally spaced relief protrusions.

2. The prefabricated vertical earth drain of claim 1 wherein said relief protrusions are continuously curved in their direction of horizontal extension.

3. The prefabricated vertical earth drain of claim 2 wherein the drain channels are defined by the curved corrugation bends through 180° arches and said relief protrusions are centered in the arches and extend in their direction of horizontal extension through an arch of approximately 120° to 180°.

4. The prefabricated vertical earth drain of claim 1 wherein said series of relief protrusions are uniformly spaced.

5. The prefabricated vertical earth drain of claim 4 wherein said series of relief protrusions are a saw-tooth configuration in longitudinal cross section along said channels.

6. The prefabricated vertical earth drain of claim 4 wherein said series of relief protrusions are a sinusoidal configuration in longitudinal cross section along said channels.

7. The prefabricated vertical earth drain of claim 4 wherein said series of relief protrusions have a longitudinal spacing which is shorter than that for said longitudinal corrugations.

8. The prefabricated vertical earth drain of claim 1 including filter fabric longitudinally surrounding said corrugated core sheet.

9. The prefabricated vertical earth drain of claim 8 wherein said relief protrusions are continuously curved in their direction of horizontal extension.

10. The prefabricated vertical earth drain of claim 9 wherein the drain channels are defined by the curved corrugation bends through 180° arches and said relief protrusions are centered in the arches and extend in their direction of horizontal extension through an arch of approximately 120° to 180°.

11. The prefabricated vertical earth drain of claim 1 wherein said relief protrusions are provided in adjacent corrugation channels and they protrude in the same direction.

12. The prefabricated vertical earth drain of claim 1 wherein said relief protrusions are provided in adjacent corrugation channels and the relief protrusions in adjacent channels earth protrude in opposite directions.

* * * * *